US010327519B2

(12) United States Patent
Hoffman

(10) Patent No.: US 10,327,519 B2
(45) Date of Patent: Jun. 25, 2019

(54) TOOL BRACELET

(71) Applicant: Black & Blue, New York, NY (US)

(72) Inventor: Asher C. Hoffman, New York, NY (US)

(73) Assignee: Black & Blue, New York, NY (US)

( * ) Notice: Subject to any disclaimer, the term of this patent is extended or adjusted under 35 U.S.C. 154(b) by 143 days.

(21) Appl. No.: 15/700,930

(22) Filed: Sep. 11, 2017

(65) Prior Publication Data

US 2019/0075894 A1 Mar. 14, 2019

(51) Int. Cl.

| | |
|---|---|
| ***A44C 5/00*** | (2006.01) |
| ***A45F 5/00*** | (2006.01) |
| ***B67B 7/00*** | (2006.01) |
| ***A44C 25/00*** | (2006.01) |
| ***B25F 1/04*** | (2006.01) |
| ***B26B 11/00*** | (2006.01) |
| ***A44C 5/20*** | (2006.01) |

(52) U.S. Cl.

CPC ..... *A44C 5/003* (2013.01); *A44C 5/0053* (2013.01); *A44C 5/2033* (2013.01); *A44C 25/007* (2013.01); *A45F 5/00* (2013.01); *B25F 1/04* (2013.01); *B26B 11/00* (2013.01); *B67B 7/00* (2013.01); *A45F 2005/008* (2013.01)

(58) Field of Classification Search

CPC ..... A44C 5/0007; A44C 5/003; A44C 25/007; B26B 11/00; B25F 1/04; A45F 5/00; A45F 2005/008

USPC ..... 63/1.12

See application file for complete search history.

(56) References Cited

U.S. PATENT DOCUMENTS

| | | | | |
|---|---|---|---|---|
| 8,925,348 | B2 * | 1/2015 | Gagne | A44C 5/0007 63/1.12 |
| 9,084,455 | B2 * | 7/2015 | Millan | B26B 9/00 |
| 9,528,204 | B2 | 12/2016 | King et al. | |
| 2013/0031935 | A1 * | 2/2013 | Kelleghan | A44C 5/00 63/1.12 |
| 2015/0282571 | A1 * | 10/2015 | Gendron | A44C 5/0007 206/372 |
| 2017/0340070 | A1 * | 11/2017 | Bloch | A44C 5/003 |

OTHER PUBLICATIONS

Leatherman, "Tread Wearable Multi-Tools" retrieved from http://www.leatherman.com/tread?gclid=EAIaIQobChMIpa6-xf_X1QIVBgVpCh2A5AiLEAAYASAAEgKFzvD_BwE. Aug. 14, 2017, p. 1-2.

* cited by examiner

*Primary Examiner* — Abigail E Troy
(74) *Attorney, Agent, or Firm* — Leason Ellis LLP

(57) ABSTRACT

A jewelry article having a functional component that can be worn as a bracelet is provided. The bracelet includes a rigid portion that defines a portion of the circumferential perimeter of the bracelet. A flexible band is removeably connected at one end of the rigid portion via a clasp and the flexible band is connected at the other end of the rigid portion to define the remaining circumferential perimeter of the bracelet. A plurality of beads are disposed along the flexible band. Each bead includes a tool head and the bead can be engaged with the rigid portion while disposed on the flexible band so that a force applied to the rigid portion can be transmitted to the tool head on the bead to perform an operational function. One tool or more can also be pivotally connected to rigid portion and pivoted from a stored position to an extended position.

14 Claims, 5 Drawing Sheets

TOOL BRACELET

FIELD OF THE INVENTION

This patent application generally relates to jewelry, and more particularly to jewelry having tethered tools.

BACKGROUND OF THE INVENTION

Often times it is desirable to keep a set of tools on one's person so that these tools are typically always on hand should the need to use the tools arise. For example, pocket knives and small, folding multi-tool units can be carried in a pocket and/or attached to a key chain. However, these devices can be bulky and uncomfortable to carry in a pocket. Moreover, the usefulness of pocket-style tool systems are limited since items that are required to be separately placed in a pocket are often forgotten, users may not always have clothing with pockets, and items can often inadvertently fall out of pockets.

There have been attempts to provide wearable tool devices, such as in the form a bracelet. However, certain wearable devices are provided as rigid linkages similar to a metal watch band that incorporate tool features. Once such device is the Tread Bracelet by LEATHERMAN of Portland, Oreg. However, the types of tools that can be incorporated are limited since they are limited by the size of each individual linkage. Moreover, the number of tools that can be incorporated is limited because there are a limited number of linkages that can fit around a user's wrist. In addition, these linkages can be difficult to remove and/or replace, thereby further limiting the versatility of these devices. The links of the full metal bracelet are relatively large and wide, which creates issues with respect to weight and comfort for the wearer.

The present invention provides a solution to these and other problems.

SUMMARY OF THE INVENTION

In one aspect of the invention, a jewelry article having a functional component is provided. The jewelry article defines a circumferential perimeter that is sized and shaped to permit the jewelry article to be worn by a user. The jewelry article includes a rigid portion. The rigid portion defines a portion of the circumferential perimeter of the jewelry article. The rigid portion has first and second ends and a head portion attached at the first end thereof. The head portion includes an engagement member. A clasp is supported by the head portion. A flexible band is sized and shaped to be removeably connected to the first end of the rigid portion via the clasp at one end thereof. The other end of the flexible band is connected to a second end of the rigid portion. A plurality of beads are disposable on the flexible band. Each bead has an aperture sized and shaped to receive the flexible band therethrough so that each bead can rotate and translate with respect to the flexible band. Each of the plurality of beads has a respective tool head, each tool head being capable of performing a tool function. Each of the plurality of beads has a respective complimentary engagement member, each complimentary engagement member being sized and shaped to selectively engage with the engagement member of the head. In a first condition the one end of the flexible band is removeably connected to the first end of the rigid portion via the clasp and defines a complimentary portion of the circumferential perimeter such that the rigid portion and the flexible band cooperate so as to be capable of being worn by the user. In a second condition the one end of the flexible band is disconnected from the first end of the rigid portion and one of the plurality of beads remains positioned along the flexible band and engaged with the head via engagement of the engagement member and complimentary engagement member.

According to a further aspect, a tool is pivotally connected to the rigid portion, wherein the rigid portion defines a housing sized and shaped to receive the tool in a first condition, and wherein in a second condition the tool is pivoted to an extended position.

According to a still further aspect, the tool is a knife.

According to a yet further aspect, the tool and the rigid portion have a curved profile.

According to a further aspect, the tool includes at least one of a cutting edge, a serrated edge, a stripping notch, an abrasive surface, and combinations thereof.

According to another aspect, each tool head comprises at least one of a philips screw driver tip, a flat head screw driver tip, a star driver tip, a allen-key/hex tip, a socket receptacle, a fire starting material, and a spoke wrench.

According to a still further aspect, the flexible band has a length such that each bead can be positioned along the flexible band and engaged with the head of the rigid portion.

According to a yet further aspect, the flexible band has a length such that the flexible band and the rigid portion define the circumferential perimeter such that the jewelry article can be worn by the user in a two-wrap configuration.

According to a further aspect, the engagement member is a protrusion extending from the head of the rigid portion and the complimentary engagement member of each bead is a receptacle defined thereby that is sized and shaped to receive the protrusion and permit force applied to the rigid portion to be transmitted therethrough.

According to another aspect, the head includes a set of surfaces that are sized and shaped and distanced to engage a cap of a bottle therebetween such that upon an application of force to the rigid portion the cap of the bottle can be removed.

According to a further aspect, the head can be used to remove the cap of the bottle while the jewelry is being worn.

According to a still further aspect, the clasp includes a closure, the closure being operable to selectively open and close.

According to a yet further aspect, the closure is pivotally supported by the head portion.

According to a still further aspect, the closure is spring biased to a closed position with respect to the clasp.

These and other aspects, features, and advantages can be appreciated from the accompanying description of certain embodiments of the invention and the accompanying drawing figures and claims.

BRIEF DESCRIPTION OF THE DRAWINGS

The accompanying drawing figures illustrate an exemplary embodiment and are not intended to be limiting of the invention.

DETAILED DESCRIPTION OF CERTAIN EMBODIMENTS OF THE INVENTION

The invention is now described with reference to the accompanying drawing figures, which form a part hereof, and which show, by way of illustration, an example implementation and/or embodiment of the present invention. It is to be understood that other embodiments can be implemented and structural changes can be made without departing from the spirit of the present invention. Among other things, for example, the disclosed subject matter can be embodied as methods, devices, components, or systems.

Furthermore, it is recognized that terms may have nuanced meanings that are suggested or implied in context beyond an explicitly stated meaning. Likewise, the phrase "in one embodiment" as used herein does not necessarily refer to the same embodiment and the phrase "in another embodiment" as used herein does not necessarily refer to a different embodiment. It is intended, for example, that claimed subject matter can be based upon combinations of individual example embodiments, or combinations of parts of individual example embodiments.

Figure 1:
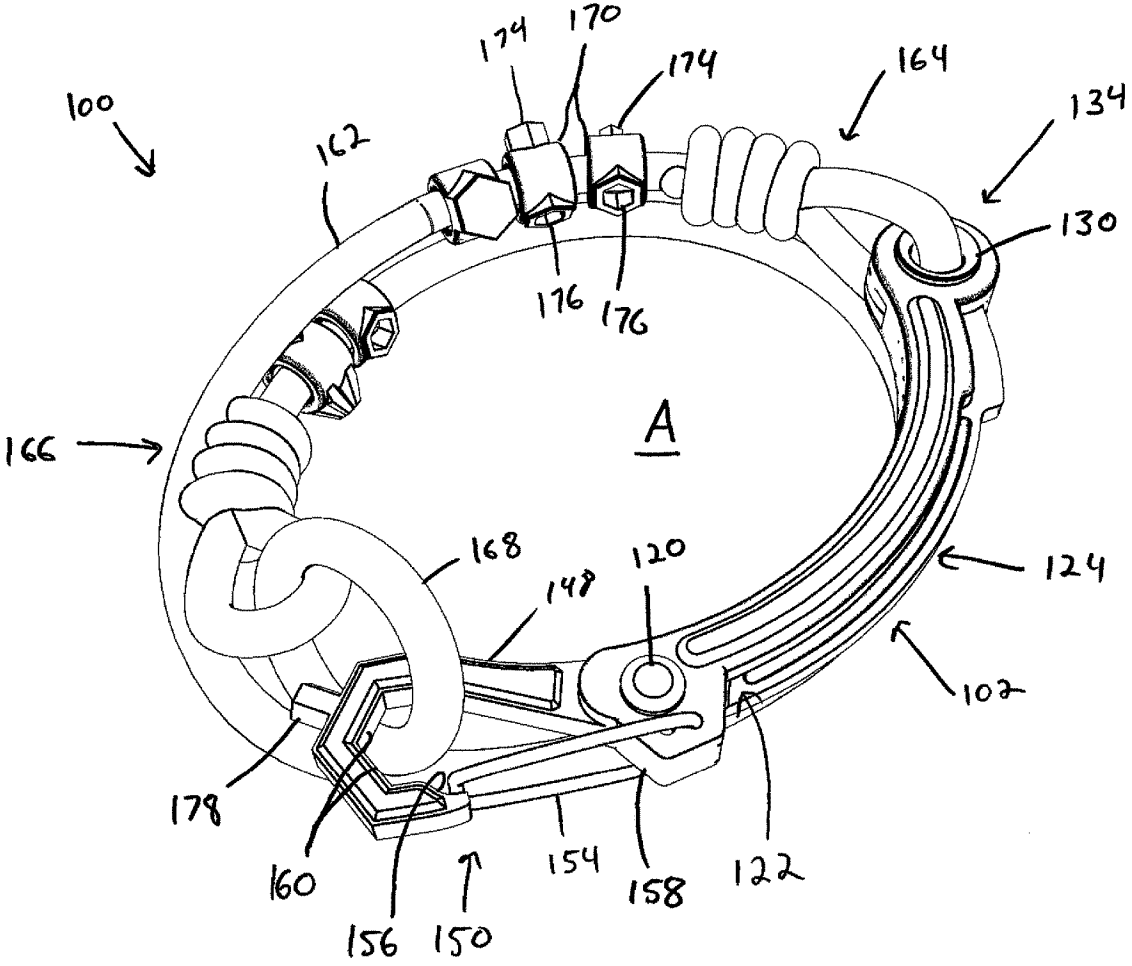
FIG. 1 illustrates an article of jewelry having utilitarian features according to an embodiment of the invention.
Figure 2:
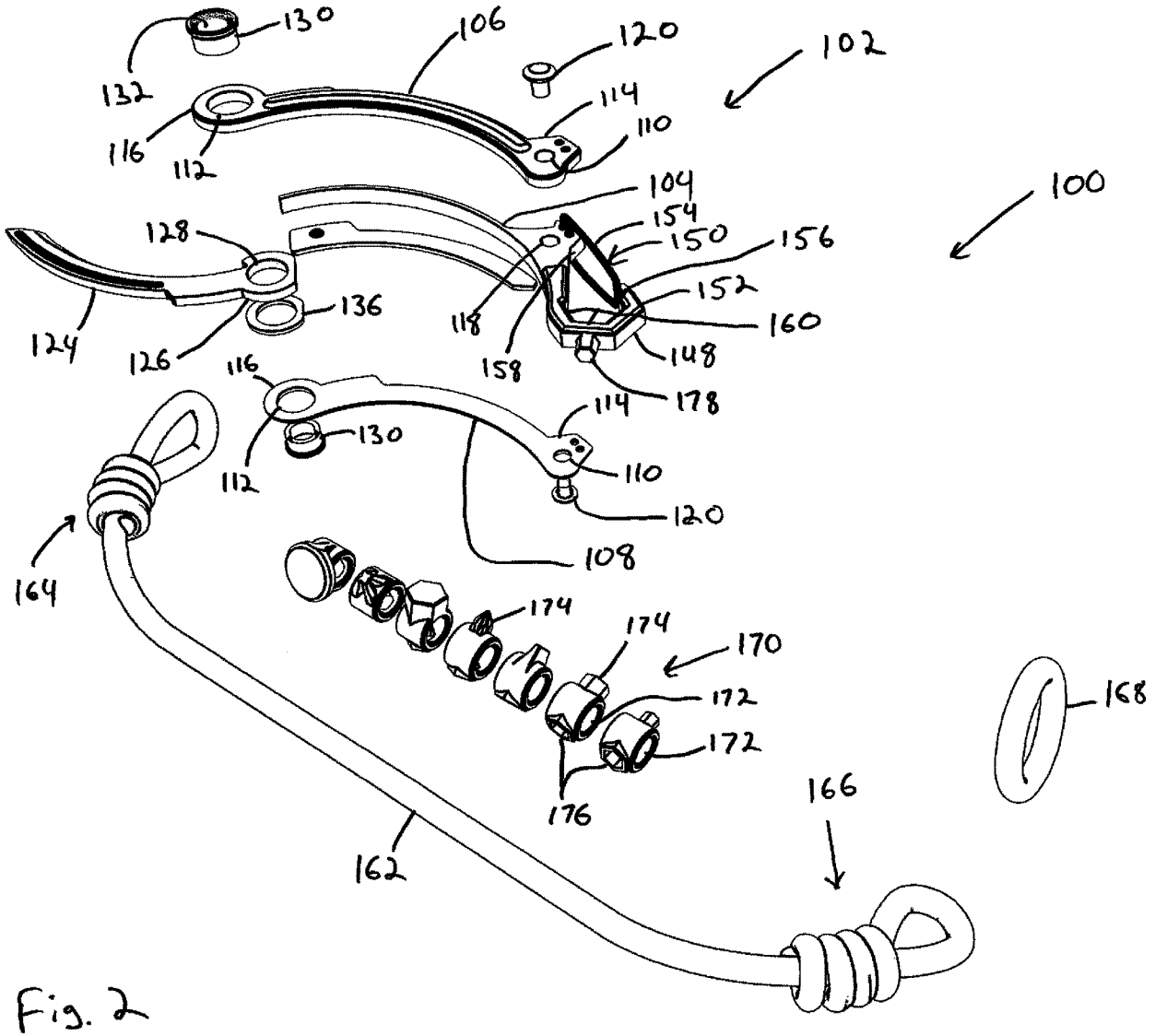
FIG. 2 is an explode view thereof.

Referring to FIGS. 1 and 2, a jewelry article having tethered tools 100 is shown. The jewelry article 100 has an aesthetically pleasing visual appearance and therefore can be worn as an ornamental article of jewelry. The jewelry article 100 is comfortable to wear due, at least in part, to its ergonomic shape, selection of materials (e.g., light weight, form fitting), and the ability to adjust the size in fine increments to obtain a more comfortable fit without requiring tools to adjust the size. The jewelry article 100 also has various tool features and can be used as a tool, as discussed in more detail below.

The jewelry article 100 is in the form of a bracelet. The bracelet 100 is sized and shaped to be worn about an extremity of a user, for example, a wrist. The bracelet 100 includes a rigid portion 102. The rigid portion can be made from metal, for example, or other suitable, rigid materials such as carbon fiber composites or ceramics or combinations thereof. The metal can be, for example, stainless steel, titanium, and/or a semi-precious metal or combinations thereof. For example, the rigid portion 102 can also be finished with a high polish, brushed metal, black anodized, gun metal blue, or other similar finish that gives the rigid portion 102 an aesthetically pleasing appearance.

The rigid portion 102 can be formed as an assembly and include a spine member 104 and two rib members 106 and 108. The spine and rib members 104, 106, and 108 have a curved shape so that it can be more comfortably worn, for example, around a wrist as a bracelet-type jewelry article. The rigid portion 102 is curved and extends to form at least a portion of the circumferential perimeter of the bracelet. For example, the rigid portion can form approximately a third, a half, or two thirds of the circumferential perimeter of the bracelet, or more or less and various lengths in between.

The ribs 106 and 108 can be disposed on opposite sides of the spine 104. The ribs 106 and 108 include first and second apertures 110 and 112 formed in first and second lobes 114 and 116 at opposite ends of each respective rib. The spine 104 includes an aperture 118 disposed at one end thereof. In an assembled condition, apertures 110 of ribs 106 and 108 are aligned with aperture 118 of the spine 104. A fastener 120 is sized and shaped to be disposed through the apertures 110 and 118 to connect the spine 104 and ribs 106 and 108 together. The fastener 120 can be, for example, a rivet, a two-part threaded rivet, or a two-part threaded fastener, or other suitable fastener systems.

In the assembled condition, the spine 104 and ribs 106, 108 form a housing 122 in which the spine 104 provides the rear wall and the ribs 106, 108 provide sidewalls. Tool 124 is sized and shaped to be received within the housing 122. Tool 124 includes a lobe 126 at one end. An aperture 128 is disposed in the lobe 126 of the tool 124. In an assembled condition, apertures 112 in ribs 106 and 108 are aligned with aperture 128 of the tool 124. A thru-fastener 130 having a central thru-hole 132 is sized and shaped to be disposed through the apertures 112 and 128 to form a pivot joint 134 to pivotally connect tool 124 and ribs 106 and 108 together. The thru-fastener 130 can be, for example, a rivet, a two-part threaded rivet, or a two-part threaded fastener, or other suitable fastener system that has a central thru-hole 132. A washer 136 can be included in the pivot joint 134.

Figure 3:
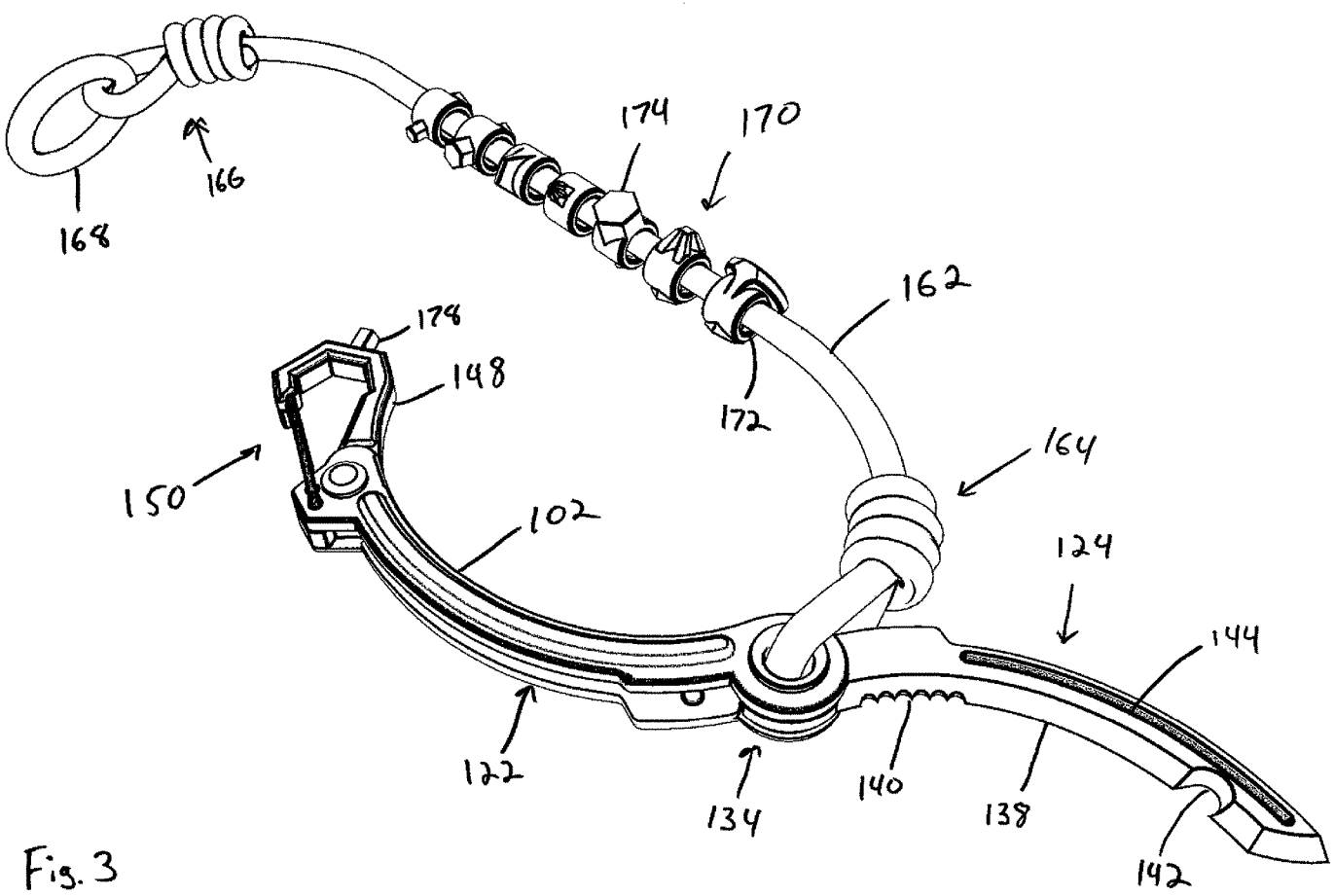
FIG. 3 shows a tool of the jewelry article in an extended position.

The tool 124 can pivot into the housing 122 to define a stored position, as shown in FIG. 1, and can pivot out of the housing to define an extended position, as shown in FIG. 3. The tool 124 can be made from metal and have a finish similar to spine 104 and ribs 106, 108 so that the tool has an aesthetically pleasing, ornamental appearance as an article of jewelry and also has a structural integrity to also functional as a tool. The tool 124 can be, for example, a knife. As shown in FIG. 3, the tool 124 can have a cutting edge 138, a serrated edge 140, a stripping notch 142, an abrasive surface 144, or a combination thereof. Other tools that can be pivoted into and out of the housing 122, such as, for example, a pick tool, a wine opening tool, a fully serrated-edge sawing tool, or other suitable tools. These other tools can be included in addition to the knife-type tool 124 or as an optional replacement, or be excluded for a more simplified version of the jewelry article.

The spine 104 prevents the tool 124 from pivoting toward and entering the interior area of the bracelet 100 to prevent the tool from coming in contact with, for example, a wrist of the wearer. A stop plate 146 can also be included in the assembly and be attached to one of the ribs 106, 108. The stop plate 146 or liner lock mechanism locks the tool 124 (e.g., knife blade) in place. The stop plate 146 extends from the rib surface toward the tool 124, which can also prevent the tool from moving towards the interior of the bracelet.

Figure 4:
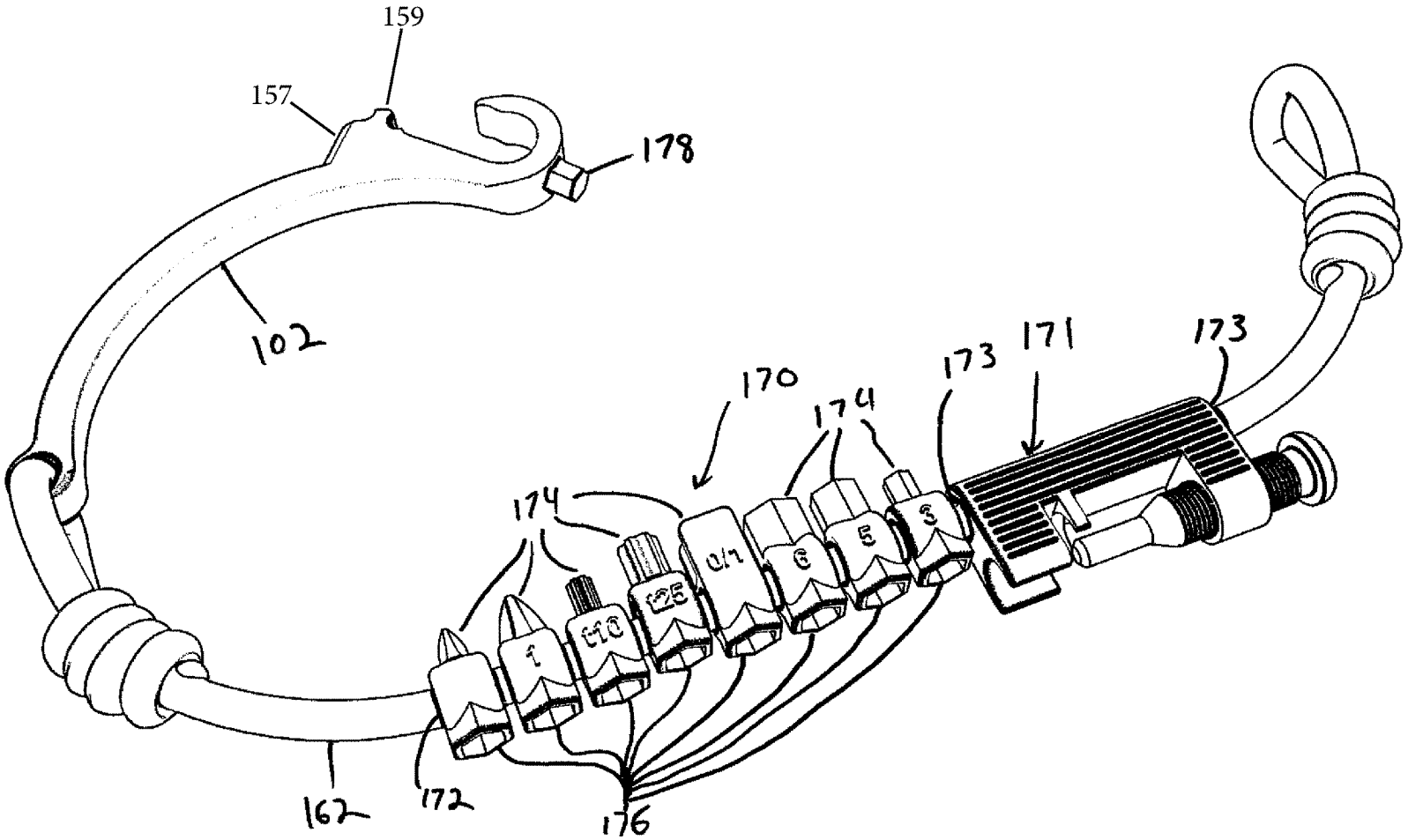
FIG. 4 shows the jewelry article in an operational configuration.

The spine 104 includes a head 148. The head 148 includes a clasp mechanism 150. The clasp 150 includes a hook shaped portion 152 and a spring-loaded closure 154, in the illustrated embodiment. The spring-loaded closure 154 is pivotally attached to the head 148 and can be rotated inwardly so that, for example, a ring or loop of rope can be inserted into the clasp 150. Once inserted, the closure 154 rotates back to the closed position to hold the ring or loop therein. The closure 154 can be depressed inwardly to open the clasp 150 so that the ring or loop can be removed. The closure 154 optionally can be disposed through apertures in the ribs 106, 108, which can further maintain the ribs and spine in an assembled condition. Different closures can be used to complete the clasp 150, as would be appreciated by those of skill in the art. Alternatively, the closure 154 can be omitted (as shown in FIG. 4, for example) as discussed in more detail below.

The head 148 includes a curved tip 156 at one end and a heel 158 that has a flat surface at the other end of the head. The tip 156 and heel 158 provide a set of surfaces that are sized and shaped and spaced from each other such that these surfaces can be used to open a bottle by, for example, prying off a bottle cap from a bottle. In use, a bottle cap on the top of a bottle is disposed between the tip 156 and heel 158 (thereby causing the closure 154 to depress inwardly). The rigid portion 102 can be gripped by the user to rotate the head 148, which causes the set of surfaces to engage and remove the bottle cap. Optionally, the bottle cap can be engaged between the set of surfaces of the head 148 while the user is still wearing bracelet 100. The bottle cap can then be removed by rotating the wrist while still wearing the bracelet and so this operation can be performed without removing the bracelet.

The interior of the head 148 can, as shown in the illustrated embodiment, include multiple interior flat surfaces 160 arranged in a hexagonal pattern. The interior flat surfaces 160 can be sized and shaped so that a standard sized nut or head of a bolt (e.g., SAE or Metric) can be disposed between the surfaces 160. The head 148 can be rotated like a wrench to transmit a torque force through the interior surfaces 160 to rotate a nut and/or bolt engaged therewith. Alternatively, the interior of the head 148 can have a different interior, such as curved. The head 148 can also include an tapered section 157 that can be used as a box opening tool, for example, and a flat tip portion 159 that can be used to securely engage a lid to a can (e.g., close a paint can) as one exemplary use.

As discussed above, the jewelry article 100 includes a rigid portion 102 as one portion of the jewelry article. A jewelry article 100 further includes a flexible band 162. The flexible band 162 can comprise a length of rope, paracord, braided string, cord, flexible and/or braided wire, or other similar flexible rope-like materials. The flexible band 162 can be a useful tool itself to be used for binding, tying, etc., which can be particularly useful as a survival tool. The flexible band 162 can have a braided construction so that upon unbraiding, the length of rope material is longer. As a further option, the flexible band can have a composite construction with multiple filaments that can include, for example, fishing line, snare wire, and waxed jute fiber used for starting a fire, which can be used in conjunction with other aspects of the jewelry article 100 making the article more useful as a survival and emergency use item. An exemplary composite cord is disclosed in U.S. Pat. No. 9,525,204, which is incorporated by reference herein in its entirety. The flexible band 162, when made from certain material and/or color combinations, provides the flexible band 162 with an aesthetically pleasing, ornamental appearance while also having structure integrity. Moreover, the use of flexible, lightweight materials for the flexible band 162 increases the comfort for the wearer. The flexible band 162 can more readily conform to the user's anatomy and can adjust shape as the user movers. The relative thinness of the flexible band further increases comfort. The thin, rope-like construction of the flexible band is less likely to impede user movement (e.g., a bend of the wrist).

The flexible band 162 can include looped knots 164 and 166 formed at both ends thereof. Knot 164 can be formed through the central thru-hole 132 of thru-fastener 130 and be disposed through the apertures 128 and 112 of the tool 124 and ribs 106 and 108, respectively. Accordingly, the flexible band 162 is attached in a semi-permanent manner to the rigid portion 102 via knot 164. Knot 164 can be arranged such that a user can untie and retie knot 164 if it is necessary (e.g., to change out tool 124 for another tool), but the knot 164 should remain tied to the rigid portion 102 during typical use.

At the other end of the flexible band 162 knot 166 is tied about ring 168. Ring 168 can be made from a metal and have a finish similar to the rigid portion 102 so that the ring has an aesthetically pleasing, ornamental appearance as an article of jewelry and also has a structural integrity. The ring 168 is sized and shaped so that it can be inserted into and be selectively, removably retained by clasp 150. Accordingly, when the ring 168 is retained in clasp 150 it attaches the other end of the flexible band 162 to the rigid portion 102. The ring 168 can be removed from the clasp 150 via manipulation of the closure 154 to separate one end of the flexible band 162 from the rigid portion, as discussed in more detail below. Alternatively, the closure 154 can be omitted (as shown in FIG. 4, for example) and the ring 168 can be seated about the hook shaped portion 152 of the clasp 150 and held in place by the tension of the flexible band 162. The length of the flexible band 162 can be easily adjusted to more precisely fit a particular user's writs. Accordingly, the length of the flexible band 162 can be adjusted such that in a worn configuration, the ring 168 (or knot 166 if ring 168 is omitted) can be pulled to seat about the hook shaped portion 152 of the clasp 150 and once that pulling force is released, the resting tension and precise sizing of the flexible band maintains the flexible band (knot or ring) engaged with the clasp and the jewelry in position during typical wearing.

A plurality of beads 170 can be disposed along the flexible band 162. Beads 170 can be made from a metal and have a finish similar to the rigid portion 102 or a contrasting appearance so that the beads have an aesthetically pleasing, ornamental appearance as an article of jewelry and also have a structural integrity to be used as a tool. The beads 170 have a thru-hole 172 that allows the beads 170 to rotate about and slide along the flexible band 162. The flexible band 162 can have a circular or near-circular cross-section, if desired, to facilitate the rotation and translation of the beads 170 along the flexible band 162. The beads can be finished in order to minimize sharp edges and improve comfort to a user wearing the bracelet 100.

The beads include a tool head 174. The tool head 174 can be one of many various typical tools, such as a philips screw driver tip, a flat head screw driver tip, a star driver tip, a allen-key/hex tip, a socket receptacle, a spoke wrench, and a fire starting material (e.g., magnesium material, flint, striker, etc.), and various other tools of various sizes. Various combinations of beads 170 can be included on the flexible band 162 so that an assortment of beads that would be typically provided for performing certain tasks are included. For example, a general purpose assortment of beads can include common tools such as philips, flat, and hex driver head, as shown in FIG. 2. As another example, an assortment of beads that include tools for a specific purpose, such as bicycle and bicycle chain repair, can be included, as shown in FIG. 4. Various other combinations and special purpose combinations of beads 170 with tool heads 174 can be included on the flexible band 162. A common tool function is driving a fastener (e.g., screw, bolt, nut, machine screw, etc.). Accordingly, the combination of beads 170 can include at least one bead that includes a tool head 174 capable of driving a fastener (e.g., a philips screw driver tip, a flat head screw driver tip, a star driver tip, a allen-key/hex tip, a socket receptacle, etc.). A specialized bead 171, such as a chain breaker/riveting tool for repairing bike chains, can also be provided and disposed on the flexible band 162, as shown in FIG. 4. The specialized bead 171 includes a thru-hole 173 so that it can be disposed on flexible band 162 and translate and rotate with respect thereto. As another example, the bracelet can have a combination of tools for a survival/emergency scenario. In one such arrangement the bracelet can include a specialized bead that supports a small compass, one or beads that are made from fire tinder material (e.g., magnesium) that can be shaved to provide fire tinder, a striker tool that can be pivotally stored within housing 122 and a bead made from flint material, the flexible band can include snare wire and a bead can include locking features (e.g., the bead can include a small cam lock of directional barbs) that can be used in combination with the snare wire, the bracelet can include a glass breaking tool to aid emergency escape from an automobile. In certain instances, the ring 168 can be used as a finger pull in combination with flexible band 162 (e.g., for use as a fire spindle).

Figure 5:
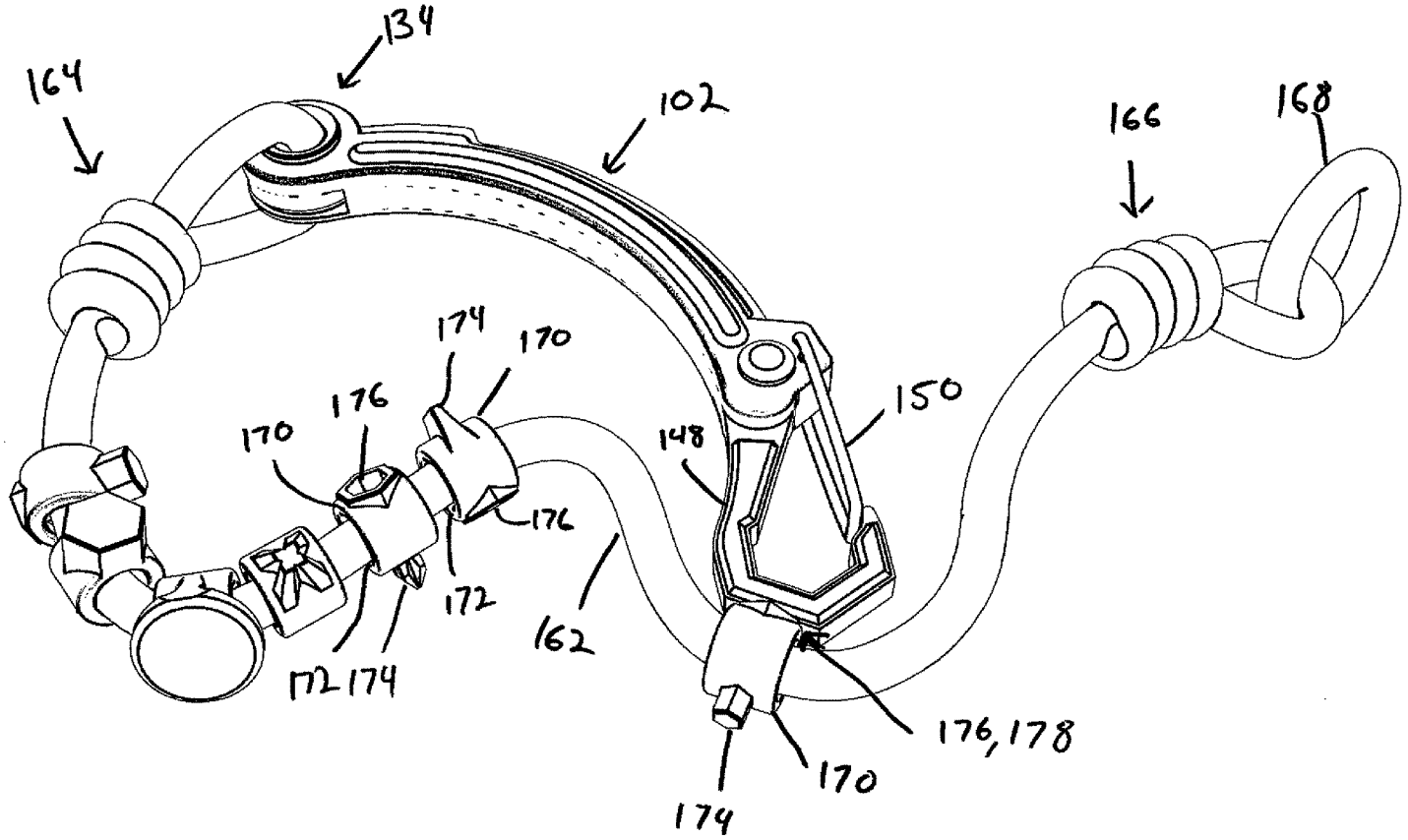
FIG. 5 shows the jewelry article having additional, optional tools.

The head 148 of the spine 104 can have an engagement member and the beads 170 can each have a complimentary engagement member. The beads 170 can have a connector portion 176 in the form of a receptacle that is sized and shaped to engage with a protrusion 178 on the head 148 of the spine 104 of the rigid portion 102 (in a similar fashion, the head can include a receptacle for engagement with a protrusion on the bead). The complimentary engagement members of the bead 170 and the engagement member of the head 148 (e.g., receptacle 176 and protrusion 178) provide a structural arrangement in which the bead 170 can be removeably engaged with the rigid portion 102 to perform a utilitarian tool function. Accordingly, when a bead 170 is engaged with the head 148, as shown in FIG. 5, the rigid portion 102 provides a handle to hold the bead 170 and assist in applying torque to the bead (e.g., to use the tool head 174 to rotate a screw). The protrusion and receptacle can have corresponding flat surfaces that engage to transmit a torque force from the rigid portion 102 through the bead 170 to the tool head 174. As will be appreciated, the protrusion 178 can extend from or generally be defined along a different part of the spine 104, ribs 106 and 108, or other parts of the housing 122.

In an example of use, the ring 168 is detached from the clasp 150 thereby detaching one end of the flexible band 162 from the rigid portion 102. A selected bead 170 is translated along the flexible band 162 into position relative to the protrusion 178 on head 148 and the bead 170 is rotated so that the connector 176 on the bead can be engaged with the protrusion 178. With the bead engaged, the rigid portion 102 can then be used to torque the bead 170 to operate as a tool and perform a tool function. Once the operation is complete, the bead 170 can be disengaged from head 148 and the ring 168 can be reinserted into the clasp 150 so that the flexible band 162 is reattached to the rigid portion 102 at both ends to reform the round shape of the bracelet 100.

In one preferred embodiment, the flexible band 162 has a length such that there is sufficient room to position every bead 170 for engagement with the protrusion 178 while the beads remain disposed on the flexible band, with the other beads 170 that are not in use disposed along the flexible band 162 to either side of the bead 170 that is engaged with the head 148 (see, e.g., FIG. 5). The flexible band 162, in this embodiment, has an interval length that permits the flexible band to be wrapped around the user (e.g., wrist) and worn as an article of jewelry without inadvertently falling off the user. For example, as shown in FIG. 1, the flexible band 162 has a length that permits it to be wrapped approximately one and a half times about a user (e.g., wrist), the other half of a rotation being provided by the rigid portion to provide a bracelet that provides two wraps. Accordingly, in the example shown in FIG. 1, the curved rigid portion 102 provides approximately one half of the circumferential perimeter of the bracelet 100 and the flexible band 162 provides a second half of the circumferential perimeter of the bracelet 100 to form a first wrap and the flexible band 162 provides a further full circumferential perimeter in the form of a second wrap of the bracelet 100. The length of the flexible band 162 can be increased so that it can wrap two and a half times or more to provide a bracelet 100 having three or more wraps, for example. Having a longer flexible band 162 can increase the number of beads 170 that can be supported thereon while also changing the aesthetic appearance of the bracelet (e.g., having an multi-wrap bracelet provides a distinct, ornamental appearance). In additional, the length of the flexible band 162 can be adjusted incrementally to increase or decrease the diameter of the internal area "A" of the bracelet in order to accommodate differences in size of a user (e.g., smaller or larger wrists) and to provide a tighter or looser fit.

Knots 164 and 166 can be untied in order to add or remove beads 170 or possibly during use of the beads on the protrusion 178. In addition, purely ornamental beads (e.g., beads lacking a tool head 174 and a connector 176 that are included with the hybrid ornamental-functional beads 170) can be included on flexible band 162 in order to enhance the aesthetic quality of the jewelry article 100. Ring 168 can also be omitted and looped knot 166 can be directly retained by clasp 150. Moreover, knot 164 can be untied and, in the case that fastener 130 is removable, fastener 130 can be removed so that tool 124 can be removed and/or replaced with a different tool, and the bracelet can be reassembled by reinserting fastener 130 and retying knot 164.

Notably, the accompanying figure(s) and examples above are not meant to limit the scope of the present application to a single implementation, as other implementations are possible by way of interchange of some or all of the described or illustrated elements. Moreover, where certain elements of the present application can be partially or fully implemented using known components, only those portions of such known components that are necessary for an understanding of the present application are described, and detailed descriptions of other portions of such known components are omitted so as not to obscure the application. In the present specification, an implementation showing a singular component should not necessarily be limited to other implementations including a plurality of the same component, and vice-versa, unless explicitly stated otherwise herein. Moreover, applicants do not intend for any term in the specification or claims to be ascribed an uncommon or special meaning unless explicitly set forth as such. Further, the present application encompasses present and future known equivalents to the known components referred to herein by way of illustration.

The foregoing description of the specific implementations will so fully reveal the general nature of the application that others can, by applying knowledge within the skill of the relevant art(s) (including the contents of the documents cited and incorporated by reference herein), readily modify and/or adapt for various applications such specific implementations, without undue experimentation, without departing from the general concept of the present application. Such adaptations and modifications are therefore intended to be within the meaning and range of equivalents of the disclosed implementations, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one skilled in the relevant art(s). It is to be understood that dimensions discussed or shown are drawings are shown accordingly to one example and other dimensions can be used without departing from the invention.

While various implementations of the present application have been described above, it should be understood that they have been presented by way of example, and not limitation. It would be apparent to one skilled in the relevant art(s) that various changes in form and detail could be made therein without departing from the spirit and scope of the application. Thus, the present application should not be limited by any of the above-described example implementations.

What is claimed:

1. A jewelry article having a functional component, the jewelry article defining a circumferential perimeter that is sized and shaped to permit the jewelry article to be worn by a user, comprising:

a rigid portion, the rigid portion defining a portion of the circumferential perimeter and having first and second ends;

a head portion attached to the rigid portion at the first end thereof, the head portion having an engagement member;

a clasp supported by the head portion;

a flexible band, wherein one end of the flexible band is sized and shaped to be removeably connected to the first end of the rigid portion via the clasp, and wherein an other end of the flexible band is connected to the second end of the rigid portion;

a plurality of beads disposable on the flexible band, each bead having an aperture sized and shaped to receive the flexible band therethrough so that each bead can rotate and translate with respect to the flexible band;

each of the plurality of beads having a respective tool head, each tool head being capable of performing a tool function; and each of the plurality of beads having a respective complimentary engagement member, each complimentary engagement member being sized and shaped to selectively engage with the engagement member of the head, wherein in a first condition the one end of the flexible band is removeably connected to the first end of the rigid portion via the clasp and defines a complimentary portion of the circumferential perimeter such that the rigid portion and the flexible band cooperate so as to be capable of being worn by the user, wherein in a second condition the one end of the flexible band is disconnected from the first end of the rigid portion and one of the plurality of beads remains positioned along the flexible band and engaged with the head via engagement of the engagement member and the complimentary engagement member.

2. The jewelry article according to claim 1, further comprising a tool pivotally connected to the rigid portion, wherein the rigid portion defines a housing sized and shaped to receive the tool in a first condition, and wherein in a second condition the tool is pivoted to an extended position.

3. The jewelry article according to claim 2, wherein the tool is a knife.

4. The jewelry article according to claim 2, wherein the tool and the rigid portion have a curved profile.

5. The jewelry article according to claim 2, wherein the tool includes at least one of a cutting edge, a serrated edge, a stripping notch, an abrasive surface, and combinations thereof.

6. The jewelry article according to claim 1, wherein each tool head comprises at least one of a philips screw driver tip, a flat head screw driver tip, a star driver tip, a allen-key/hex tip, a socket receptacle, a fire starting material, and a spoke wrench.

7. The jewelry article according to claim 1, wherein the flexible band has a length such that each bead can be positioned along the flexible band and engaged with the head of the rigid portion.

8. The jewelry article according to claim 1, wherein the flexible band has a length such that the flexible band and the rigid portion define the circumferential perimeter such that the jewelry article can be worn by the user in a two-wrap configuration.

9. The jewelry article according to claim 1, wherein the engagement member is a protrusion extending from the head of the rigid portion and the complimentary engagement member of each bead is a receptacle defined thereby that is sized and shaped to receive the protrusion and permit force applied to the rigid portion to be transmitted therethrough.

10. The jewelry article according to claim 1, wherein the head includes a set of surfaces that are sized and shaped and distanced to engage a cap of a bottle therebetween such that upon an application of force to the rigid portion the cap of the bottle can be removed.

11. The jewelry article according to claim 10, wherein the head can be used to remove the cap of the bottle while the jewelry is being worn.

12. The jewelry article according to claim 1, wherein the clasp includes a closure, the closure being operable to selectively open and close.

13. The jewelry article according to claim 12, wherein the closure is pivotally supported by the head portion.

14. The jewelry article according to claim 12, wherein the closure is spring biased to a closed position with respect to the clasp.

* * * * *